US009591713B2

(12) United States Patent
Tikkanen et al.

(10) Patent No.: US 9,591,713 B2
(45) Date of Patent: Mar. 7, 2017

(54) APPARATUS AND METHOD FOR MONITORING AND LIMITING POWER TO SSL DEVICES

(71) Applicant: LUMASTREAM CANADA ULC, Calgary (CA)

(72) Inventors: David Tikkanen, Waterloo (CA); Kyle Hathaway, Kitchener (CA)

(73) Assignee: LUMASTREAM CANADA ULC, Calgary, Alberta (CA)

( * ) Notice: Subject to any disclaimer, the term of this patent is extended or adjusted under 35 U.S.C. 154(b) by 0 days.

(21) Appl. No.: 14/893,375

(22) PCT Filed: Jun. 25, 2014

(86) PCT No.: PCT/CA2014/050609
§ 371 (c)(1),
(2) Date: Nov. 23, 2015

(87) PCT Pub. No.: WO2014/205575
PCT Pub. Date: Dec. 31, 2014

(65) Prior Publication Data

US 2016/0128144 A1 May 5, 2016

Related U.S. Application Data

(60) Provisional application No. 61/838,965, filed on Jun. 25, 2013.

(51) Int. Cl.
*H05B 33/08* (2006.01)

(52) U.S. Cl.
CPC ..... *H05B 33/089* (2013.01); *H05B 33/0815* (2013.01); *H05B 33/0887* (2013.01); *H05B 33/0896* (2013.01)

(58) Field of Classification Search
CPC ..... H05B 33/0815; H05B 33/0818; H05B 33/0827; H05B 37/02; H05B 37/029;
(Continued)

(56) References Cited

U.S. PATENT DOCUMENTS 7,671,571 B2 * 3/2010 Burlak ..... H02M 1/32 323/275
7,804,189 B2 9/2010 Koehler et al.
(Continued)

FOREIGN PATENT DOCUMENTS

| | | |
|---|---|---|
| CA | 2273324 | 4/1998 |
| CA | 2742843 | 5/2010 |
| CA | 2761294 | 11/2010 |

OTHER PUBLICATIONS

Canadian Intellectual Property Office as International Searching Authority, International Search Report and Written Opinion for International Patent App. No. PCT/CA2014/050609, Oct. 7, 2014.

*Primary Examiner* — Vibol Tan
(74) *Attorney, Agent, or Firm* — Gowling WLG (Canada) LLP; Jeffrey W. Wong

(57) ABSTRACT

The disclosure is directed at a system, method and apparatus for monitoring and limiting power supplied to a solid state lighting (SSL) device when an operational fault condition is sensed such as when the power level being supplied to the device is sensed to be meeting or higher than an expected or predetermined level. The system, method and apparatus provide a recovery aspect which means that the SSL device will not be automatically shut down (or power being supplied to the SSL device will not be immediately stopped) upon the discovery of the operational fault condition but will enter a recovery mode. The system may be used for white light general illumination applications as well as to color changing applications.

13 Claims, 9 Drawing Sheets

(58) Field of Classification Search
CPC ..... H05B 39/04; H05B 41/36; H05B 33/089; H05B 33/0896
See application file for complete search history.

(56) References Cited

U.S. PATENT DOCUMENTS

| | | | | |
|---|---|---|---|---|
| 8,299,987 | B2 * | 10/2012 | Neudorf | H05B 33/0818 315/169.3 |
| 8,525,446 | B2 * | 9/2013 | Tikkanen | H05B 33/0815 315/291 |
| 8,638,045 | B2 * | 1/2014 | Kunst | H05B 33/0815 315/185 S |
| 8,957,601 | B2 * | 2/2015 | Tikkanen | H05B 33/0803 315/294 |
| 8,975,825 | B2 * | 3/2015 | Hu | H05B 33/0854 315/239 |
| 9,024,541 | B2 * | 5/2015 | Xie | H02M 3/33507 315/224 |
| 9,049,759 | B2 * | 6/2015 | Tikkanen | H05B 33/0815 |
| 2011/0204820 | A1 * | 8/2011 | Tikkanen | H05B 33/0815 315/294 |

* cited by examiner

APPARATUS AND METHOD FOR MONITORING AND LIMITING POWER TO SSL DEVICES

CROSS REFERENCE TO RELATED APPLICATIONS

This application claims the benefit of priority of U.S. Provisional Patent Application No. 61/838,965 filed Jun. 25, 2013, which is hereby incorporated by reference.

BACKGROUND OF THE DISCLOSURE

Continuing development of solid state lighting (SSL) devices such as light emitting diodes (LEDs) or LED arrays, as well as organic LEDs (OLEDs), for low power and high power general illumination applications has introduced a need to limit power within predetermined limits to these devices to mitigate or reduce over-temperature or abnormal operation of these SSL devices. Such a power limit capability is desirable under internal or external fault conditions, transient load conditions, as well as ambient temperature conditions.

In terms of fault conditions, OLEDs may have failure mechanisms that include an increase in impedance. In this failure mode, the increased impedance results in increased power dissipation for a fixed LED drive current which may, however, increase the risk of the SSL device being a fire hazard.

In terms of ambient temperature conditions, low and high power LEDs vary in voltage drop with operating junction temperatures whereby as the junction temperature increases, the voltage drop across the LED is reduced. Conversely, if the junction temperature is reduced, the voltage drop across the LED is increased.

For instance, in a cold ambient operating temperature such as −40° C., the LED voltage drop is highest during initial cold start conditions at power up. This results in a higher initial power requirement during turn on and operation until the voltage drop across the LED drops as its junction temperature increases. Cold start operating requirements and corresponding power requirements can exceed predetermined power limits such as defined by UL1310 Class 2 power levels of 100 watts or any other predetermined value.

Approaches exist to limit power and current to an LED load as a result of an external failure of the LED load or an internal failure of a component within an LED power source. One common approach is to disable or turn off the LED power source if an over power or over current condition is detected. Another approach is to implement a "hiccup" mode whereby the output of the LED power source is continually cycled on and off in an over power or over current condition. However, it is not always ideal to immediately disconnect power to a LED load under transient conditions caused by a potential fault, an AC mains transient, a load transient or a temporary overload condition.

Therefore, there is provided a novel apparatus and method for monitoring and limiting power to SSL devices.

SUMMARY OF THE DISCLOSURE

The present disclosure is directed at a system, apparatus, and method for monitoring and limiting power to solid state lighting (SSL) devices such as light emitting diodes (LEDs). More specifically, the current disclosure is directed at a method and apparatus which, after the determination of a fault operation condition, assists in the recovery process for providing power to the SSL device without having to automatically shut down the system or apparatus of providing power. This is beneficial when the fault operation condition is a simple transient matter and not a permanent fault. If the issue is determined to be a permanent fault, then the system of the disclosure may be shut down.

In one embodiment, the disclosure provides an apparatus and method for configuring a power limit function to specific power levels while remaining within Class 2 power levels to address the variability in electrical circuits and variability in electrical characteristics of the LED loads.

In one aspect, there is provided an apparatus for controlling power to a solid state lighting (SSL) device load comprising a power circuit for receiving power from an external source; at least one power limit connected to the power circuit; at least one output current driver for supplying a load power to the SSL device load, the at least one output current driver connected to the at least one power limit; and a power limit controller; wherein the power circuit transmits the power to the at least one power limit which, in turn, transmits a current to the at least one output current driver; wherein the power limit controller directly or indirectly monitors a level of the load power and controls the at least one power limit to reduce the level of the load power for a predetermined period of time when the load power exceeds a predetermined power limit.

In another aspect, there is provided a method of controlling power to a solid state lighting (SSL) device load comprising receiving an input power, delivering load power to the SSL device load, monitoring current level in load power, limiting load power to the SSL device for a predetermined period of time after a predetermined operational fault condition is met.

BRIEF DESCRIPTION OF THE DRAWINGS

Embodiments of the present disclosure will now be described, by way of example only, with reference to the attached Figures.

DETAILED DESCRIPTION OF PREFERRED EMBODIMENT

The disclosure is directed at a system, method and apparatus for monitoring and limiting power supplied to a solid state lighting (SSL) device when an operational fault condition is sensed such as when the power level being supplied to the device is sensed to be meeting or higher than an expected or predetermined level. The system, method and apparatus provide a recovery aspect which means that the SSL device will not be automatically shut down (or power being supplied to the SSL device will not be immediately stopped) upon the discovery of the operational fault condition but will enter a recovery mode. If the system of the disclosure is unable to respond to the recovery mode to overcome the operational fault condition, power being delivered or supplied to the SSL device may then be stopped causing the SSL device to be shut down. While much of this disclosure refers to light emitting diodes (LEDs), other SSL devices may be used without loss of generality. The disclosure is also directed at a system, method, and apparatus for configuring a power limit to address the variability in electrical circuits and variability in electrical characteristics of SSL devices.

The system of the disclosure may be used for white light general illumination applications as well as color changing applications.

It is advantageous to monitor the power being supplied to the LED load and reduce the power level first before asserting a shutdown of the system of the disclosure.

Figure 1A:
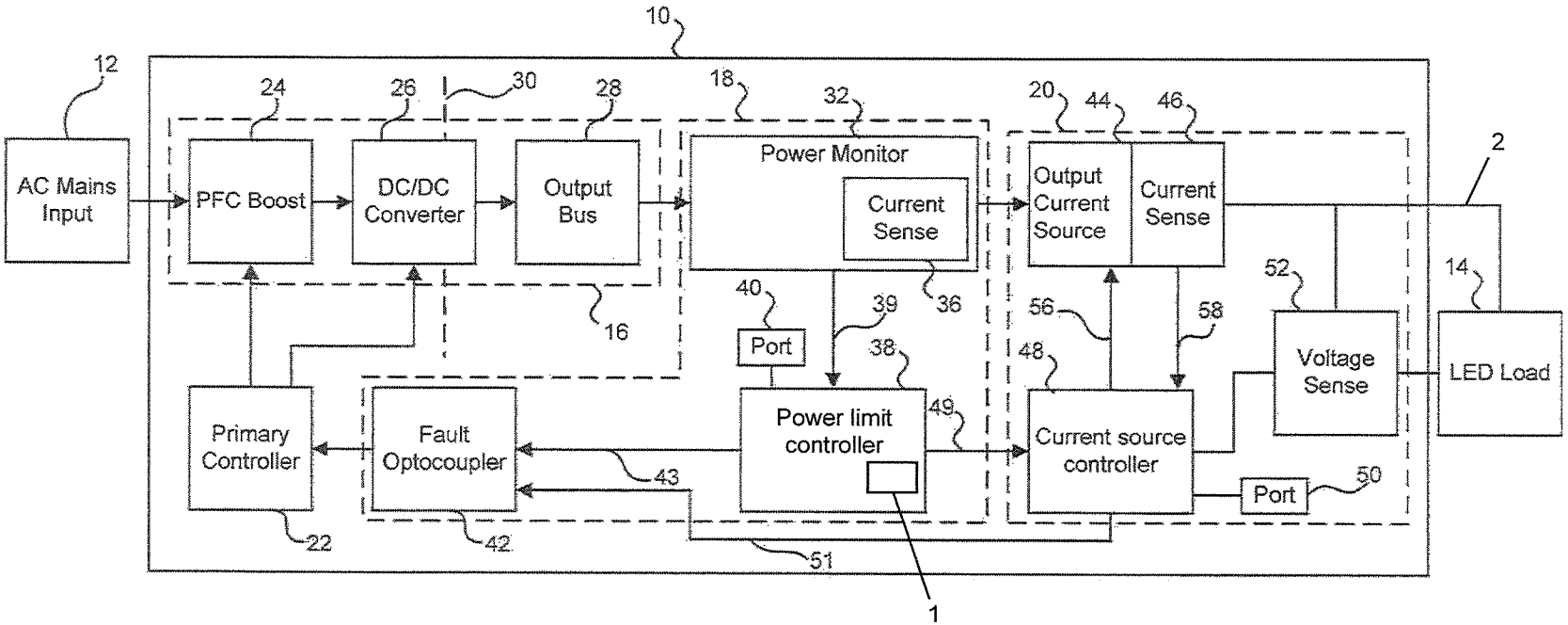
FIG. 1*a* is a schematic diagram of a first embodiment of an apparatus for providing power to a solid state lighting (SSL) device.

Turning to FIG. 1*a*, a schematic diagram of an apparatus for providing power to a SSL device, such as a LED power source, is shown. The LED power source 10, which may also be referred to as a LED driver or LED power supply, receives power from an AC mains input 12 and then controls and delivers power to an external LED load 14 (which may be seen as the SSL device). The LED power source 10 includes a power circuit 16 which is connected to a power limit 18 which, in turn, is connected to an output current driver 20. For simplicity, only one power limit 18 and one output current driver 20 is shown, however, any number of power limits 18 and output current drivers 20 may be integrated within the LED power source 10. Further, although shown in one to one relation, there may be one power limit 18 associated with multiple output current drivers 20 and vice versa. In the current figure, a single output current driver 20 is connected to the LED load 14, however the output of one of more output current drivers 20 may be connected to one or more external LED loads 14.

In the preferred embodiment, the LED power source 10 includes multiple power conversion stages to convert AC power (from the AC mains input 12) to DC power for the external LED load 14. The source 10 further includes apparatus for monitoring and limiting the power being supplied to the load 14 when an operational fault condition arises, such as, but not limited to, when the power level being supplied to the load is sensed to be above a normal or expected threshold. In one embodiment, the power may be sensed in the output current driver by means of the current sense, a voltage sense and current source controller as described below.

The LED power source 10 further includes a primary, or power circuit, controller 22 which is connected to the power circuit 16 and the power limit 18.

The power circuit 16 includes a power factor conversion (PFC) boost 24, a DC/DC converter 26 and an output bus 28. The PFC boost 22 receives power from the AC mains input 12 while the output bus 28 is connected to the power limit 18. The primary controller 22 is connected to the PFC boost 24 and the DC/DC converter 26 to provide signals, such as control signals, to these circuits. A galvanic isolation barrier 30, typically implemented as part of a full bridge converter within the DC/DC converter 26, provides an electrical safety barrier between the low voltage of the output bus 28 and the high voltage levels of the AC mains input 12, the PFC boost 24 and the primary side of the DC/DC converter 26.

In a more specific embodiment of FIG. 1*a*, the PFC boost 24 implements a boost power conversion topology with the input from the AC mains input 12 which is typically in the range of about 100 Vac to about 300 Vac. In this specific embodiment, the PFC boost 24 outputs a loosely regulated 430 Vdc over the input AC range. The DC/DC converter 26 is derived from an isolated switch mode buck converter topology. In the preferred embodiment, the output bus 28 provides a tightly regulated output, such as, but not limited to, about 46 Vdc which is controlled by a feedback loop to the primary controller 22 (as will be described in more detail below).

The power limit 18 provides an apparatus to limit power to the external LED load 14 in the event of an operational fault condition such as, but not limited to, a single component failure within the LED power source 10. The single component failure may occur within the output current source, the current sense or the current source controller. The power limit 18 may also limit power in the event of an external LED load fault or over load condition. The operational fault condition may further include a high impedance fault at the LED load. An over load condition may be a transient condition such as a cold start or power up of an LED load in ambient temperatures less than 0 degrees Celsius or an improper LED load connected to the LED power source.

The power limit 18 includes a power monitor 32 (having a current sense 36), a secondary, or power limit, controller 38 (with a port 40) and a fault optocoupler 42. In the preferred embodiment, the port 40 includes five pins for in circuit serial programming of the controller 38 and at least one pin for calibration of the power limit 18. The secondary controller 38 performs a power calculation based on an assumed tightly regulated voltage on output bus 28 and monitored current sense 36 readings. Calibration may be required to account for component tolerances in the various circuits of the LED power source 10 such as in the power monitor 32 or variations in the output bus 28 voltage to establish accurate power calculations.

Connection between the power monitor 32 and the secondary controller 38 is via a sense line 39 while the secondary controller 38 is connected to the fault optocoupler 42 via a control line 43. The fault optocoupler 42 is also connected to the primary controller 22.

The current sense 36 provides at least one analog signal to the secondary controller 38 through the sense line 39. The current sense 36 typically includes a resistor connected in series with the output bus 28 and the output current source 44 and may include ancillary circuits to scale and filter the analog control signals before transmitting the signals to the appropriate analog to digital ports in the secondary controller 38.

In operation, the secondary controller 38 includes an averaging digital filter 1 which takes a set, such as 1024, of readings for current over a period of time and then calculates an average value and compares this value to a predetermined power limit. In one embodiment, the predetermined power limit may be set at about 97 watts. If the power level is at or exceeds the predetermined limit, the secondary controller 38 will assert one or more power limit options.

The output current driver 20 includes an output current source 44 which is associated with, or connected to, a current sense 46. Both the output current source 44 and the current sense 46 are connected with a current source controller 48 (having a port 50) that is connected to the secondary controller 38 via a data line 49 and to the fault optocoupler 42 via data line 51. As shown in FIG. 1, the output current driver 20 further includes an optional voltage sense 52 that is connected to the current sense 46, the current source controller 48 and the LED load 14.

The current source 44 and current sense 46 may include a switch mode buck topology with a MOSFET switch implementing a hysteretic control method. The current source 44 provides a regulated output current to the LED load 14 implemented by a feedback loop 58 to the current source controller 48. The current source controller 48 may also output a dimming signal, as a result of an over power condition, implemented through a gate drive control line 56 to the output current source 44. The current source controller is typically a digitally controlled device implemented by means of a microcontroller and firmware.

In terms of power limit options, one option may be to transmit a change in light intensity command through data line 49 to the current source controller 48. This control information or words of data, is preferably transmitted over a "sync" line, "clock" line and "data" lines. The start of each word is preferably delimited by the "sync" line and the start of each bit is delimited by the "clock" line. This control information is translated by the current source controller 48 to on-time and off-time information and transmitted as a gate pulse through control line 56 to the output current source 44 in order to reduce the average output current either gradually or stepwise to the LED load 14 and a subsequent gradual or stepwise increase in average current after a period of time.

Another power limit option may include a shutdown command via control line 43 to the fault optocoupler 42 to immediately disable the power circuit 16.

Alternatively, the secondary controller 38 may complete a sequence of tasks attempting to initially reduce the power being supplied to the LED load 14 then, if it is determined that the power being supplied is still beyond a predetermined power limit (as sensed by the power monitor 32), it will then assert a shutdown of the power circuit 16. Graphs illustrating these operational fault conditions and how they may be handled in one embodiment are schematically illustrated in FIGS. 2*a* to 2*d*.

With further reference to output current driver 20, the current source controller 48 is further connected to the current source 44 and current sense 46 via control lines 56 and 58 respectively and also connected to port 50 for programming and calibrating various parameters. As shown in FIG. 1*a*, the voltage sense 52 is connected in parallel with the LED load 14, however, in other embodiments, the voltage sense 52 may be omitted.

In the current Figures and description, not all of the components or connections of the LED power source required for operation are shown as they will be understood by one skilled in the art. For example, the power circuit 16 may also include an EMI filter, inrush current limit or a bridge rectifier. With respect to connections, it will be understood that more than one sense line, control line or data line can be implemented between components even though only one line current connects these components. For example, more than one sense line may be connected between power monitor 32 and secondary controller 38 to provide current sense information to the secondary controller 38. Also, there may be multiple data line connections between the secondary controller 38 and current source controller 48.

In one embodiment of operation, the power circuit 16 is a two stage power converter comprising a PFC Boost 24 and DC/DC converter 26 both of which are controlled by the primary controller 22 to provide power to the output bus 28. The primary controller 22 transmits control signals to the PFC Boost 24 and DC/DC converter 26 and receives current sense information from the secondary controller 38. The output bus 28 typically provides a regulated voltage output with a feedback loop coupled to the primary controller 22.

Furthermore, the power from the output bus 28 is transferred to the output current source 44 of the output current driver 20 via the power limit 18. The power monitor 30 senses current or power (via the current sense 36) delivered from the output bus 28 and transmits this current information to the secondary controller 38.

In further aspects of operation, the current source 44 provides a constant current output 2 to the LED load 14 while the current sense 46 provides a feedback signal to current source controller 48 to regulate the current supplied to the LED load 14. The output voltage across the LED load 14 is variable and dependent on the forward voltage drops of the LED load 14.

The current source controller 48 regulates the output current provided to the LED load 14 and also provides apparatus for reducing the average current to the LED load 14 via a gate pulse signal with a variable duty cycle through control line 56.

With reference to power limit 18, the secondary controller 38 may be programmed to an initial predetermined power limit via port 40, such as, for example 97 watts. If necessary, subsequent calibration of the power limit is completed to account for electrical circuit tolerances or alternative predetermined power limit values. Calibration may include changing the state of the controller to "calibration mode" such as via a jumper connected to port 40; applying the appropriate load representing the predetermined power limit; and saving the applicable parameters by adjusting the constants stored in the EEPROM memory of the controller 38.

In another embodiment, the voltage sense 52 allows the current source controller 49 to monitor the power transferred to the LED load as a redundant power limit capability. In this instance, power is monitored by the current sense 46 and voltage sense 52 directly across the LED load 14. The redundant power limit capability provides back up protection in the event of a failure of the power limit 18.

In an alternative embodiment, the output current driver 20 may also perform a redundant power limit function similar to the power limit 18 whereby it can be programmed and calibrated to the predetermined power limit. In this embodiment, the secondary controller 38 is placed into calibration mode via port 40 in order to stop communication with the current source controller 48 and permit current source controller 48 to accept calibration commands through port 50.

The current sense 46 and voltage sense 52 communicate a measured value to the current source controller 48 in order to calculate power (given by the formula, power=voltage× current). If an operational fault condition such as an over power event occurs, the current source controller 48 may reduce the average current (or power) to the LED load 14 by a dimming pulse including a variable duty cycle through control line 56 to the current source 44 or the controller 48 may assert a shutdown signal through control line 51 to shut down the power circuit 16 or power source 10.

Alternatively, the current source controller 48, as part of a redundant power limit function, may also complete a sequence of attempting to reduce the output power to the LED load 14 first then, if it is determined that the output power level is still beyond predetermined limits as sensed by the voltage sense 52 or current sense 46 or both, it will then assert a shutdown of the power circuit 16.

The port 50 connected to current source controller 48 is also used for programming the output current driver 20 to the desired output current (such as, but not limited to, 350 mA or 700 mA) for the LED load 14.

Figure 1B:
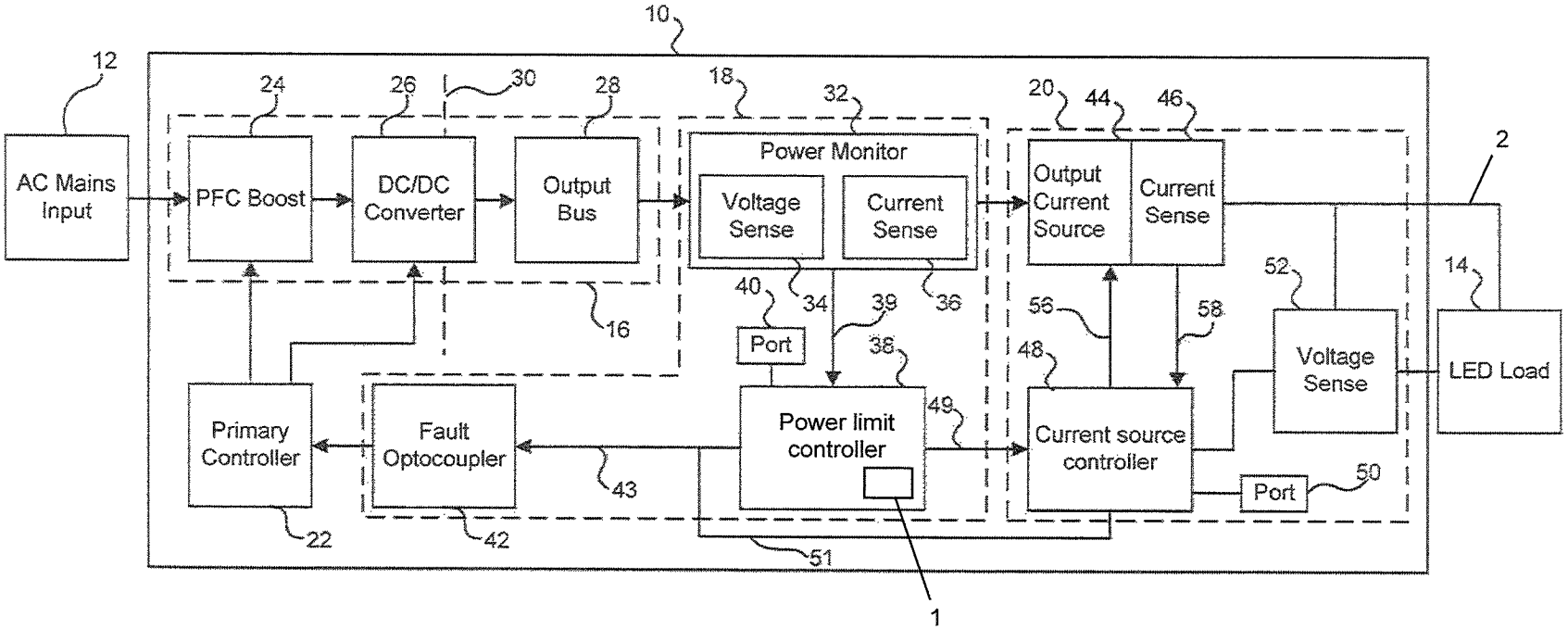
FIG. 1*b* is a schematic diagram of another embodiment of apparatus for providing power to a SSL device.

Turning to FIG. 1*b*, another embodiment of apparatus for providing power to a SSL device is shown. The embodiment of FIG. 1*b* is similar to the embodiment of FIG. 1*a* with the inclusion of a voltage sense 34 located within the power monitor 32. The embodiment of FIG. 1*b* operates in a similar manner to the embodiment of FIG. 1*a*, with the addition of further information relating to the voltage level being provided to the secondary controller.

The power limit 18 includes a power monitor 32 (having the voltage sense 34 and a current sense 36), a secondary controller 38 (with a port 40) and a fault optocoupler 42. In the preferred embodiment, the port 40 includes five pins for in circuit serial programming of the controller 38 and at least one pin for calibration of the power limit 18. The secondary controller 38 performs a power calculation based on the voltage on output bus 28 and monitored current sense 36 and voltage sense 34 readings. Calibration may be required to account for component tolerances in the various circuits of the LED power source 10 such as in the power monitor 32 or variations in the output bus 28 voltage to establish accurate power calculations The current sense 36 and voltage sense 34 provide at least one analog voltage signal to the secondary controller 38 through the sense line 39. The current sense 36 typically includes a resistor connected in series with the output bus 28 and the output current source 44. The voltage sense 34 may include a resistor divider network connected in parallel with the output bus 28. Both the current sense 36 and the voltage sense 34 may include ancillary circuits to scale and filter the analog control signals before transmitting the signals to the appropriate analog to digital ports in the secondary controller 38.

The voltage sense 34 is required if the output bus 28 is a loosely regulated or an unregulated voltage output such that the secondary controller 38 can perform a power calculation based on a voltage and current reading.

When the power from the output bus 28 is transferred to the output current source 44 of the output current driver 20 via the power limit 18, the power monitor 30 senses current (via the current sense 36) delivered from the output bus 28 and may also sense voltage (via the voltage sense 34) across the output bus 28 and transmits this current and/or voltage information to the secondary controller 38.

Turning to FIGS. 2*a* to 2*d*, schematic graphs illustrating various examples of LED power source operation when an operational fault condition occurs is shown. In the following graphs, the Y-axis relates to the power level being supplied to or used by the LED power source while the X-axis is a reflection of elapsed time. In the current figures, the power level reflected on the Y-axis is the power transmitted from output bus 28 to the input of output current source 44.

Figure 2A:
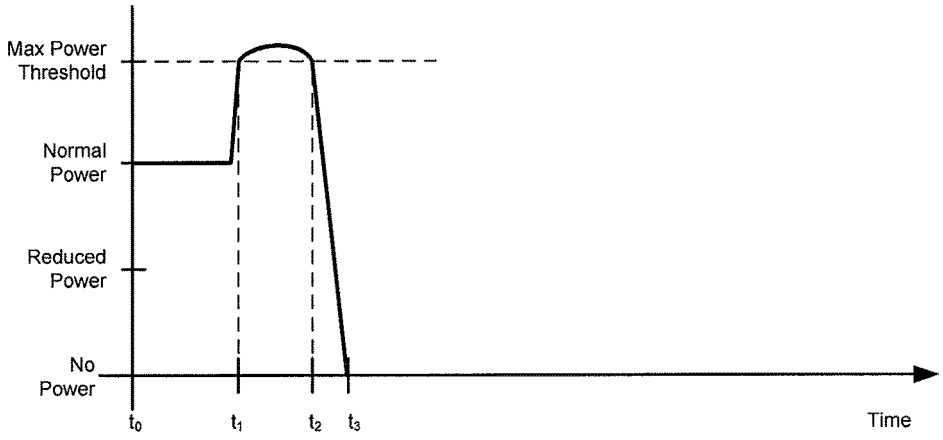
FIGS. 2*a* to 2*d* are graphs of power vs time for various SSL device operation scenarios.

FIG. 2*a* is an exemplary graph of a power limit sequence where an internal fault occurs within the LED power source or an external fault occurs with the LED load. In this example, normal power is applied to the load (starting at time t0) until the operational fault condition occurs which causes the power level being supplied by the power source to increase resulting in the power level being supplied meeting or exceeding the predetermined power limit (or maximum power threshold) at t1. Upon sensing the predetermined power limit being met or exceeded, the power limit or a redundant power limit within output current driver will attempt to reduce the power while continuing to monitor the power level for a period of time (such as between t1 and t2). If the power limit is unable to reduce the power level being supplied to an acceptable level (which is less than the predetermined power limit) between t1 and t2, the LED power source 10 is disabled at t3 via known methods.

Figure 2B:
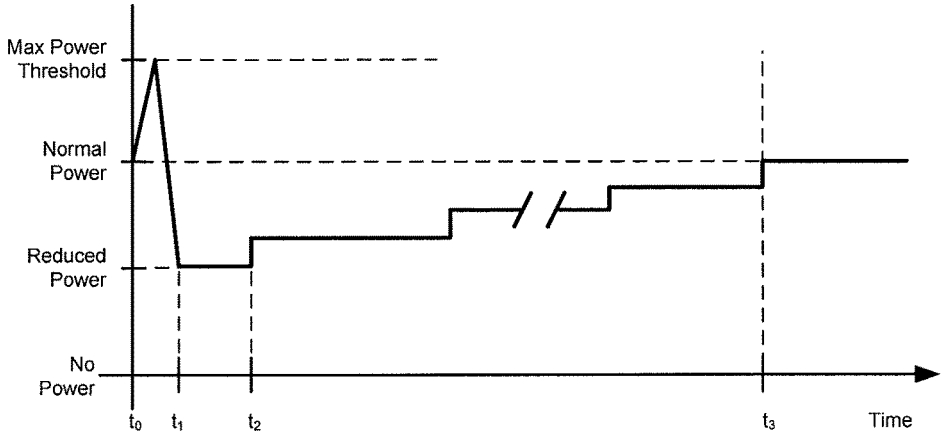

FIG. 2*b* is an exemplary graph of a cold start scenario where the power being supplied to the LED load reaches or exceeds the predetermined power limit after start up at time (t0). In response to this, the power limit or redundant power limit within output current driver steps down the power level being supplied to the LED load to a reduced power level (such as 75% of the normal power operation) at t1. It is understood that this example of a reduced power level is simply for explanation purposes and that any reduced power level is acceptable as long as it is less than the predetermined power limit. The supplied power level is continuously monitored for a period of time (t1 to t2) to confirm that the power level being supplied remains at the reduced power level. Starting at $t_2$, the power level being supplied is gradually increased for a time period (t2 to t3) in small increments towards the normal power level. In one example, the power can be increased at increments of 2.5% with a time interval between increments of 10 seconds until the normal power level is reached or sensed, however, any intervals relating to time or power may be selected.

Figure 2C:
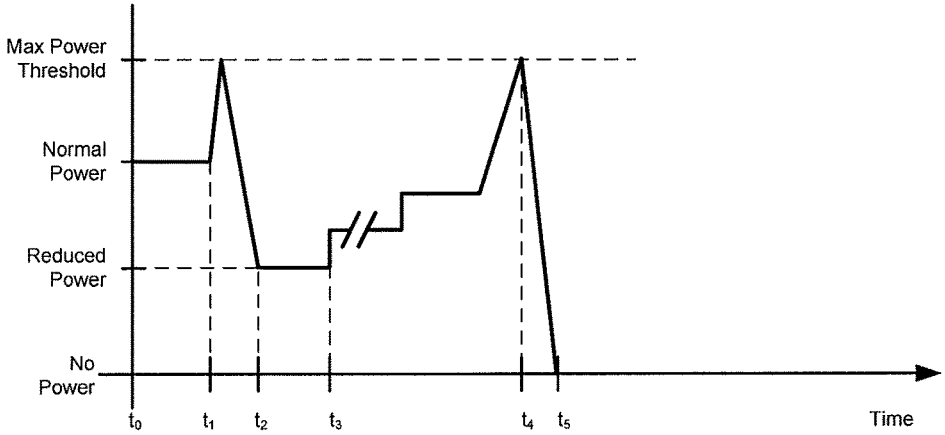

FIG. 2*c* is an exemplary graph of how another operation fault condition is handled. In the current graph, the predetermined power limit is met or exceeded at t1. In response to the power level being supplied meeting or exceeding the predetermined power limit, the power level being supplied is stepped down to a reduced level (between t1 and t2) and maintained at this level for a period of time (between t2 and t3). After time t3, the supplied power level may be gradually increased until the power level being supplied is to the normal operational power level. If the power level being supplied meets or exceeds the predetermined power limit again (such as the operational fault condition resulting in a rapid increase in power), such as at time t4, the LED power source is then disabled at t5.

Figure 2D:
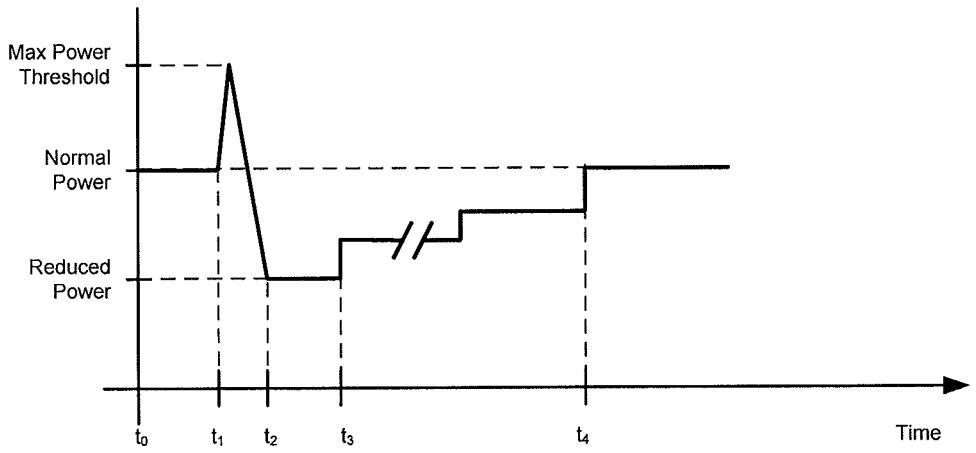

FIG. 2*d* is an exemplary graph of an operational fault condition involving a transient condition on the AC mains input. In the current graph, the input to the LED source from the AC mains input causes a transient voltage or current over shoot on the output bus resulting in a power level being supplied exceeding a predetermined power limit at t1. In response, the supplied power is stepped down at t2 and maintained at this reduced level for a period of time (between t2 and t3) and the supplied power is then gradually increased to a normal power level at t4 while continuously being monitored.

Figure 5:
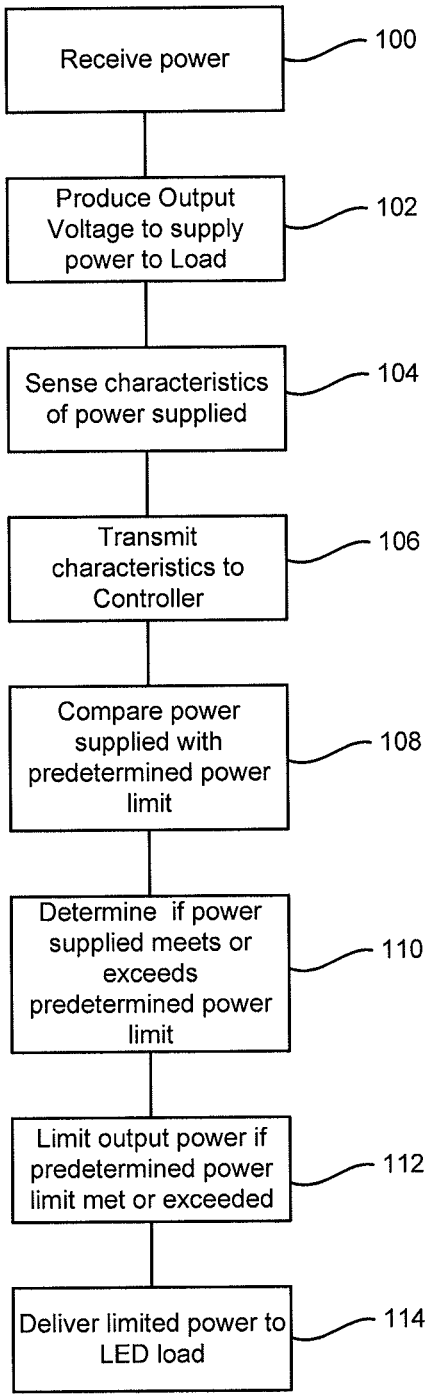
FIG. 5 is a flowchart outlining a method of monitoring and limiting power to a SSL device.

Turning to FIG. 5, a flowchart outlining a method of monitoring and limiting power provided to an SSL device when the power level being supplied meets or exceeds a predetermined power limit or threshold is shown. In operation, power is received 100 by the LED power source 10 from the AC mains input 12. After the power circuit 16 (acting as a two stage power converter) receives the power, the primary controller 22 transmits control signals to the PFC boost 24 and the DC/DC converter 26 to produce an output voltage 102 which is transmitted via the output bus 28 to the power limit 18. The primary controller 22 also receives current sense information from the PFC boost 24 and DC/DC converter 26. Voltage sense information may be supplied in embodiments where a voltage sense is included in the apparatus.

After receiving the output voltage from the output bus 28, the power monitor 32 senses the characteristics of the output bus 104 such as the current delivered by the output bus 28 (via the current sense 36) and the voltage across the output voltage bus (if the voltage sense 34 is present) and transmits this information (106) to the secondary controller 38. In other words, the power being supplied to the LED load is monitored or sensed.

The secondary controller 38 compares the received current values, and possibly the received voltage values or both to predetermined power limits 108 (whereby power=voltage×current) stored within the secondary controller 38 or within a database associated with the secondary controller. This comparison is preferably performed with only the received or sensed current values. The secondary controller then determines if the received values meet or exceed the predetermined value 110 and may assert one or more options to limit output power to the LED load 112 if the predetermined value is met or exceeded and then controls the limited output power to the output current driver 114. If the predetermined power limit is not met or exceeded, the power level being supplied is directed to the LED load without needing to be limited.

More specifically, with respect to the one or more options to limit power 112, in one embodiment, when it is sensed that the power level being supplied meets or exceeds the predetermined power limit, the power level being supplied is reduced and then monitored for a period of time such that if the power limit is unable to reduce the power level to an acceptable level within a predetermined period of time, the LED power source is disabled (such as described in FIG. 2*a*). In another embodiment of operation to limit power supplied to the load, when it is determined that the power supplied has met or exceeded a predetermined power limit, the power level being supplied is reduced to a percentage of the normal operation power level being supplied and then gradually increased until the power level being supplied reaches the normal operation power level. In yet a further embodiment, the power supplied is reduced to a percentage of the normal operation power level and then gradually increased until the supplied power level reaches the normal operation power level. However, if the normal operation power level is not reached whereby the power level being supplied again meets or exceeds the predetermined power limit, the LED power source is disabled.

As will be understood, the secondary controller 38 may limit the power from the output bus in other scenarios, such as, but not limited to transmitting a signal through a data line to the current source controller 48 to reduce the average output current either gradually or stepwise to the LED load 14 and a subsequent or stepwise increase in average current after a period of time. Alternatively, the secondary controller 38 may complete a sequence of tasks attempting to reduce the output power to the LED load first and then if it is determined that the power level being supplied still exceeds beyond a predetermined power limit, as sensed by the power monitor 32, assert a shutdown of the power circuit 16.

Figure 3A:
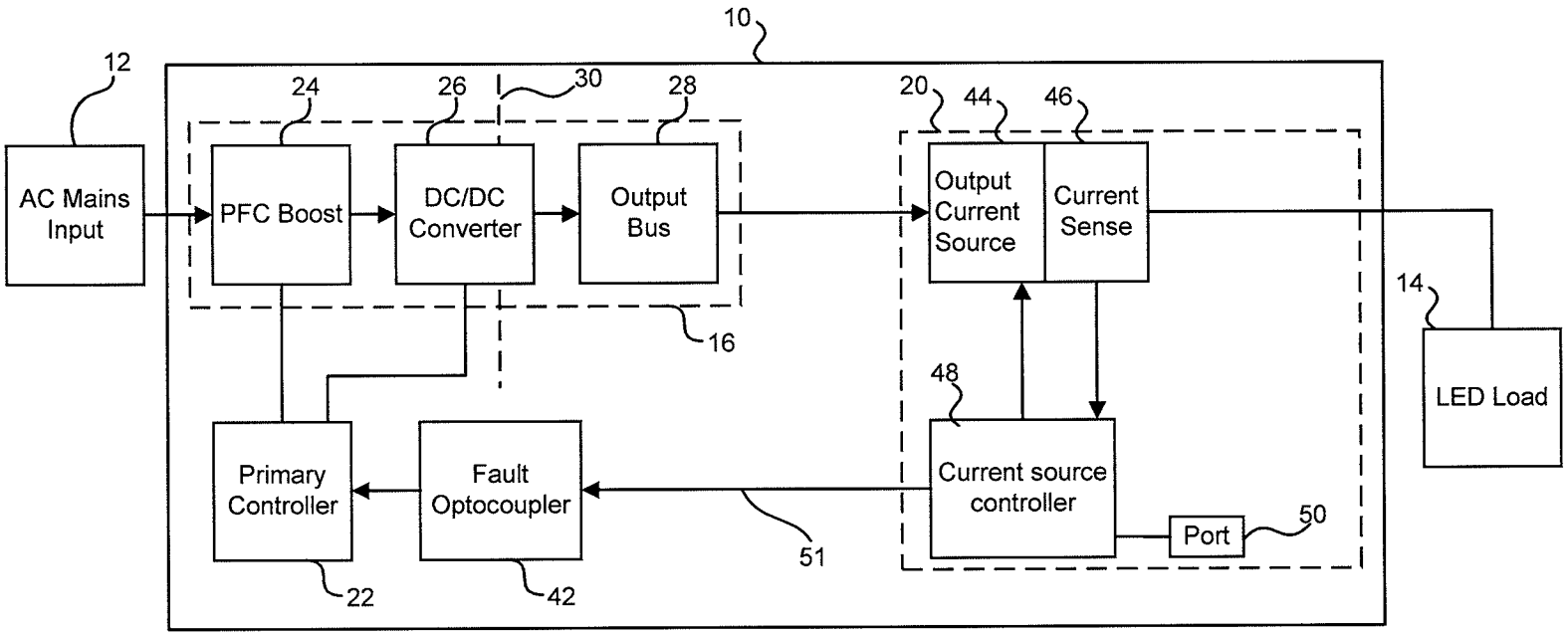
FIG. 3*a* is a schematic diagram of another embodiment of apparatus for providing power to a SSL device.

Turning to FIG. 3*a*, another embodiment of apparatus for providing power to a SSL device, such as an LED power source 10 is shown. The LED power source 10 includes a power circuit 16, an output current driver 20, a primary controller and a fault optocoupler. In this embodiment, the power limit functionality is performed via a current sense 46 and controller 48 integrated within the output current driver 20. The power circuit 16 includes a power factor conversion (PFC) boost 24, a DC/DC converter 26 and an output bus 28. The PFC boost 22 receives the power from the AC mains input 12 while the output bus 28 is connected to the output current driver 20. The primary controller 22 is connected to the PFC boost 24 and the DC/DC converter 26 to provide signals to these components. A galvanic isolation barrier 30 is integrated within the DC/DC converter 26 to provide an electrical safety barrier between the low voltage of the output bus 28 and the high voltage levels of the AC mains input 12, the PFC boost 24 and the DC/DC converter 26.

The output current driver includes an output current source 44 which is associated with, or connected to, a current sense 46. Both the output current source 44 and the current sense 46 are connected to a current source controller 48 (having a port 50) that is also connected to the secondary controller 38 via a data line.

Figure 3B:
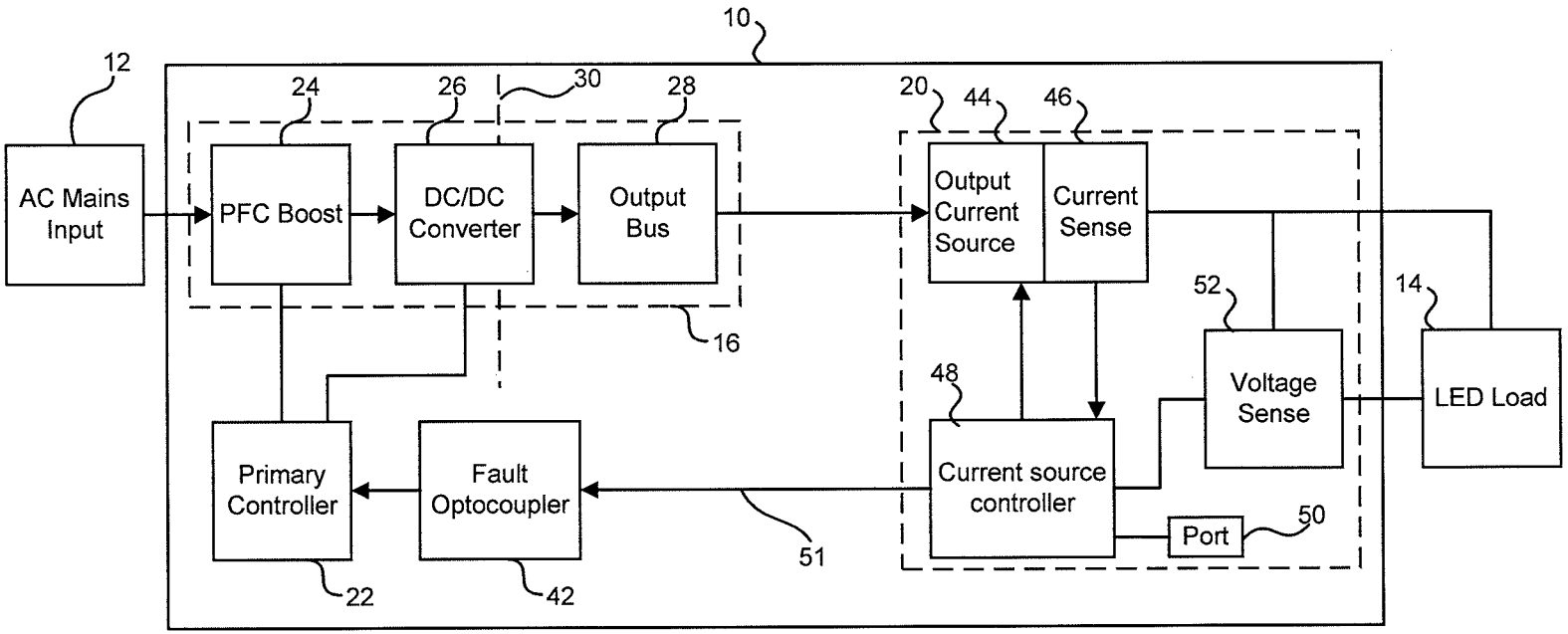
FIG. 3*b* is a schematic diagram of yet a further embodiment of apparatus for providing power to a SSL device.

Turning to FIG. 3*b*, another embodiment of apparatus for providing power to a SSL device, such as an LED power source 10 is shown. The LED power source 10 includes a power circuit 16, an output current driver 20, a primary controller and a fault optocoupler. In this embodiment, the power limit functionality is performed by a current sense 46, voltage sense 52, and controller 48 is integrated within the output current driver 20. The power circuit 16 includes a power factor conversion (PFC) boost 24, a DC/DC converter 26 and an output bus 28. The PFC boost 24 receives the power from the AC mains input 12 while the output bus 28 is connected to the output current driver 20. The primary controller 22 is connected to the PFC boost 24 and the DC/DC converter 26 to provide signals to these components. A galvanic isolation barrier 30 is located between the DC/DC converter 26 and the output bus 28 to provide an electrical safety barrier between the low voltage of the output bus 28 and the high voltage levels of the AC mains input 12, the PFC boost 24 and the DC/DC converter 26.

The output current driver includes an output current source 44 which is associated with, or connected to, a current sense 46. Both the output current source 44 and the current sense 46 are connected to a current source controller 48 (having a port 50) that is also connected to the secondary controller 38 via a data line. The output current driver 20 further includes a voltage sense 52 that is connected to the current sense 46, the current source controller 48 and the LED load 14.

Figure 4A:
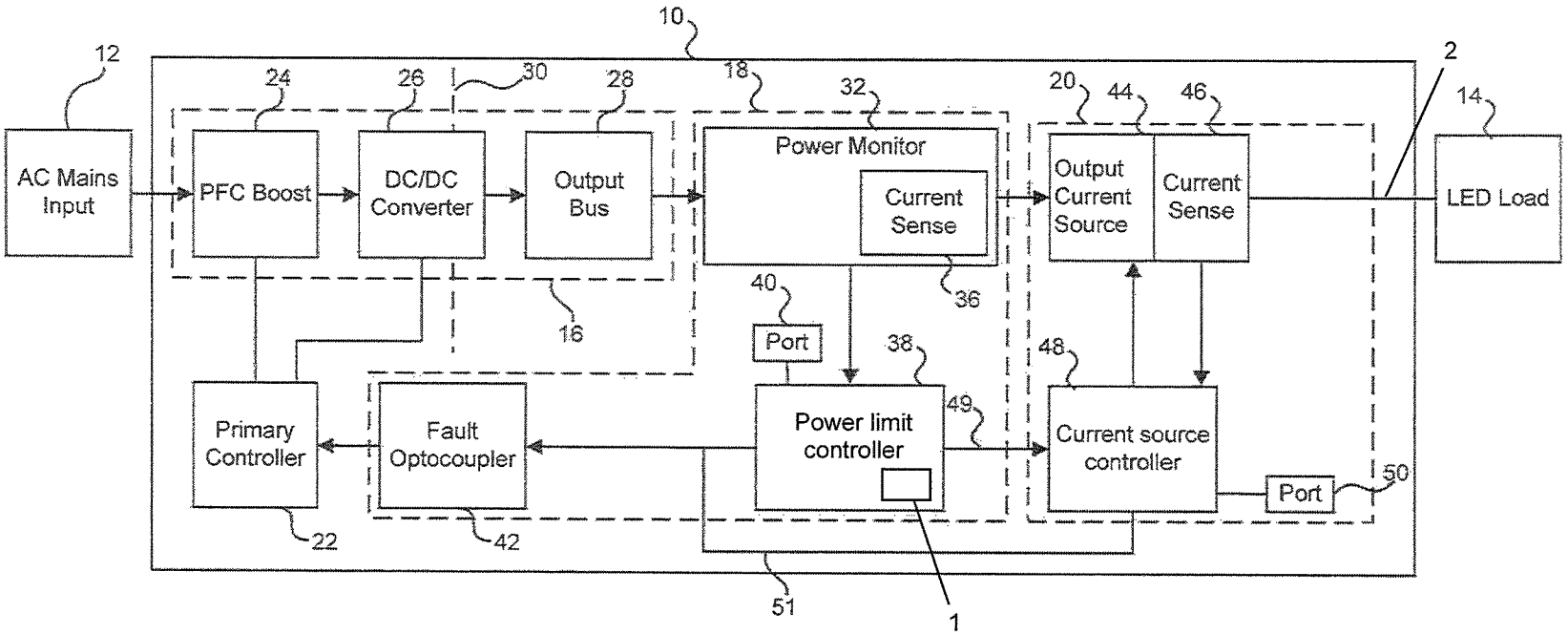
FIG. 4*a* is a schematic diagram of a fifth embodiment of apparatus for providing power to a SSL device.

Turning to FIG. 4*a*, yet another embodiment of apparatus for providing power to a SSL device, such as an LED power source 10 is shown. The power source 10 includes a power circuit 16 which is connected to a power limit 18 which, in turn, is connected to an output current driver 20.

The power circuit 16 includes a power factor conversion (PFC) boost 24, a DC/DC converter 26 and an output bus 28. The PFC boost 22 receives the power from the AC mains input 12 while the output bus 28 is connected to the power limit 18. The primary controller 22 is connected to the PFC boost 24 and the DC/DC converter 26 to provide signals to these components. A galvanic isolation barrier 30 is located within the DC/DC converter 26 to provide an electrical safety barrier between the low voltage of the output bus 28 and the high voltage levels of the AC mains input 12, the PFC boost 24 and the DC/DC converter 26.

The power limit 18 includes a power monitor 32 (including a current sense 36), connected to a secondary controller 38 with a port 40 and a fault optocoupler 42. The secondary controller 38 is connected to a fault optocoupler 42 via a control line while the fault optocoupler 42 is also connected to the primary controller 22.

The output current driver includes an output current source 44 which is associated with, or connected to, a current sense 46. Both the output current source 44 and the current sense 46 are connected with a current source controller 48 (having a port 50) that is also connected to the secondary controller 38 via a data line.

Figure 4B:
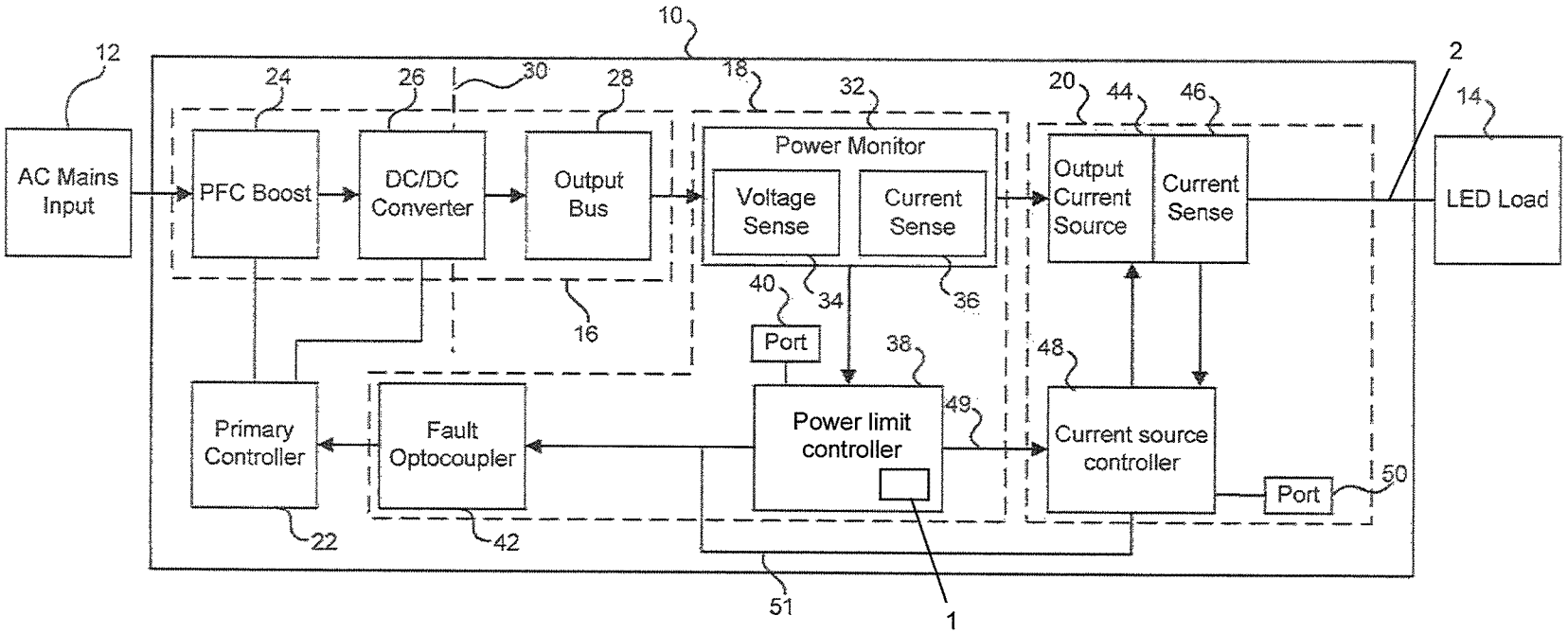
FIG. 4*b* is a schematic diagram of a sixth embodiment of apparatus for providing power to a SSL device.

Turning to FIG. 4*b*, yet another embodiment of apparatus for providing power to a SSL device, such as an LED power source 10 is shown. The power source 10 includes a power circuit 16 which is connected to a power limit 18 which, in turn, is connected to an output current driver 20.

The power circuit 16 includes a power factor conversion (PFC) boost 24, a DC/DC converter 26 and an output bus 28. The PFC boost 22 receives the power from the AC mains input 12 while the output bus 28 is connected to the power limit 18. The primary controller 22 is connected to the PFC boost 24 and the DC/DC converter 26 to provide signals to these components. A galvanic isolation barrier 30 is located within the DC/DC converter 26 to provide an electrical safety barrier between the low voltage of the output bus 28 and the high voltage levels of the AC mains input 12, the PFC boost 24 and the DC/DC converter 26.

The power limit 18 includes a power monitor 32 (comprising a voltage sense 34 and a current sense 36), connected to a secondary controller 38 with a port 40 and a fault optocoupler 42. The secondary controller 38 is connected to a fault optocoupler 42 via a control line while the fault optocoupler 42 is also connected to the primary controller 22.

The output current driver includes an output current source 44 which is associated with, or connected to, a current sense 46. Both the output current source 44 and the current sense 46 are connected with a current source controller 48 (having a port 50) that is also connected to the secondary controller 38 via a data line. The output current driver may include a voltage sense (not shown) that is connected to the current sense 46, the current source controller 48 and the LED load 14.

In an alternative embodiment, the power circuit 16 may further include at least one of an electromagnetic interference (EMI) filter, an inrush current limit and/or a bridge rectifier.

In a further embodiment, the power circuit 16 may include alternative DC/DC converter topologies. Such power conversion topologies may include, but are not limited to, a half bridge resonant converter, a flyback, or forward converter topologies. The primary controller 22 may also be two separate controllers to provide individual gate drive and feedback control signals to the PFC boost 24 and DC/DC converter 26.

With reference to power limit 18, further embodiments may include an op amp or comparator as opposed to an analog to digital port. Other embodiments may also include alternate filtering methods such as, but not limited to, a moving average filter to filter the power monitor readings.

With reference to transmitting a change in light intensity command through data line 49, alternate embodiments may include a UART, an $I^2C$ bus, SPI (Serial Peripheral Interface Bus) or a parallel communication apparatus. Other changes in light intensity or dimming methods may include a pulse width modulation method or a constant current reduction method (CCR) or a combination of various other methods. The CCR method is a continuous current flow through a LED that is reduced in order to reduce the brightness of the LED. In another embodiment, the dimming method may be implemented by various methods such as those disclosed in U.S. Pat. No. 8,299,987 or in US Patent Publication No. 2013/0049634 which are herein incorporated by reference.

In a further embodiment, the output current source 44 may further include other topologies such as boost, buck-boost, or SEPIC (single ended primary inductor converter). Alternate embodiments may also include an analog controller as opposed to a digital controller where no firmware is required for implementation. Other control methods to regulate output current to the LED load 14 may include pulse width modulation.

As an alternate embodiment, the output current source 20 may be a linear regulator with a constant current output as opposed to a switch mode topology. With respect to the secondary controller 38 and the current source controller 48, the power limit function and regulation of output current may be implemented by means of a single controller.

The above-described embodiments are intended to be examples only. Alterations, modifications and variations can be effected to the particular embodiments by those of skill in the art without departing from the scope, which is defined solely by the claims appended hereto.

What is claimed is:

1. Apparatus for controlling power to a solid state lighting (SSL) device load comprising:

a power circuit for receiving power from an external source;

at least one power limit connected to the power circuit;

at least one output current driver for supplying a load power to the SSL device load, the at least one output current driver connected to the at least one power limit; and a power limit controller;

wherein the power circuit transmits the power to the at least one power limit which, in turn, transmits a current to the at least one output current driver;

wherein the power limit controller directly or indirectly monitors a level of the load power and controls the at least one power limit to reduce the level of the load power for a predetermined period of time when the load power exceeds a predetermined power limit;

wherein if the load power exceeds the predetermined power limit, the power limit controller internally generates and transmits a signal to the current source controller to control the load power to the load;

wherein the signal is based on internal controls.

2. The apparatus of claim 1 wherein the at least one power limit is integrated within one of the at least one output current drivers.

3. The apparatus of claim 1 wherein the at least one power limit comprises:

the power limit controller;

a power monitor; and a fault optocoupler, wherein if the load power exceeds the predetermined power limit, the power limit controller transmits a signal to the fault optocoupler to control the load power.

4. The apparatus of claim 3 further comprising:

a power circuit controller;

wherein the fault optocoupler transmits a signal to the power circuit controller to control the power being supplied to the power limit.

5. The apparatus of claim 1 wherein the at least one output current driver comprises:

an output current source;

a current sense; and a current source controller.

6. The apparatus of claim 1 wherein the power limit controller comprises a digital filter.

7. The apparatus of claim 6 wherein the power limit controller comprises at least one port.

8. The apparatus of claim 7 wherein the at least one port receives instructions to calibrate the at least one power limit to the predetermined power limit.

9. The apparatus of claim 3 wherein the power monitor comprises a current sense.

10. The apparatus of claim 1 wherein the at least one output current driver reduces the load power by a pulsing technique.

11. The apparatus of claim 2 wherein the at least one power limit comprises:

the power limit controller;

a power monitor; and a fault optocoupler, wherein if the load power exceeds the predetermined power limit, the current source controller transmits a signal to the fault optocoupler to control the load power.

12. The apparatus of claim 1 wherein the at least one output current driver reduces load power by a constant current reduction technique.

13. The apparatus of claim 1 wherein the SSL device load is one of an organic light emitting diode (OLED) load, a light emitting diode (LED) load or a LED array load.

* * * * *